United States Patent [19]

Deutsch

[11] 3,952,623

[45] Apr. 27, 1976

[54] DIGITAL TIMING SYSTEM FOR AN ELECTRONIC MUSICAL INSTRUMENT

[75] Inventor: Ralph Deutsch, Sherman Oaks, Calif.

[73] Assignee: Nippon Gakki Seizo Kabushiki Kaisha, Japan

[22] Filed: Nov. 12, 1974

[21] Appl. No.: 523,034

[52] U.S. Cl. ..... 84/1.24; 84/1.25; 84/1.26; 235/152; 235/197

[51] Int. Cl.[2] ..... G10H 1/02

[58] Field of Search ..... 84/1.01, 1.03, 1.24, 84/1.25, 1.26; 235/152, 168, 197

[56] References Cited

UNITED STATES PATENTS

| | | | |
|---|---|---|---|
| 3,743,755 | 7/1973 | Watson | 84/1.01 |
| 3,749,837 | 7/1973 | Doughty | 84/1.01 X |
| 3,763,364 | 10/1973 | Deutsch et al. | 235/152 |
| 3,794,748 | 2/1974 | Deutsch | 84/1.24 |
| 3,809,786 | 5/1974 | Deutsch | 84/1.01 |
| 3,809,788 | 5/1974 | Deutsch | 84/1.01 |
| 3,809,789 | 5/1974 | Deutsch | 84/1.01 |
| 3,809,790 | 5/1974 | Deutsch | 84/1.01 |
| 3,809,792 | 5/1974 | Deutsch | 84/1.24 |
| 3,831,015 | 8/1974 | Hoff, Jr. | 235/197 |
| 3,878,750 | 4/1975 | Kapps | 84/1.01 |
| 3,885,489 | 5/1975 | Sasaki | 84/1.01 |
| 3,890,871 | 6/1975 | Oberheim | 84/1.01 |
| 3,903,755 | 9/1975 | Kondo et al. | 84/1.01 |

*Primary Examiner*—L. T. Hix
*Assistant Examiner*—Stanley J. Witkowski
*Attorney, Agent, or Firm*—Howard A. Silber

[57] ABSTRACT

Timing signals of adjustable rate are estabilished digitally in an electronic musical instrument through the use of digital timing numbers. A selected one of such numbers is repetitively added to the contents of an accumulating adder at a fixed rate. A train of timing pulses is obtained from one bit output of the adder; the rate of these pulses is directly related to the value of the selected timing number. Alternatively, consecutively updated parallel bit timing codes can be obtained from plural bit outputs of the accumulating adder. These timing codes, which are incremented or decremented in value by amounts established by the selected timing number, are useful for directly addressing a memory containing a set of musical instrument factors that are to be utilized on a time dependent basis.

10 Claims, 5 Drawing Figures

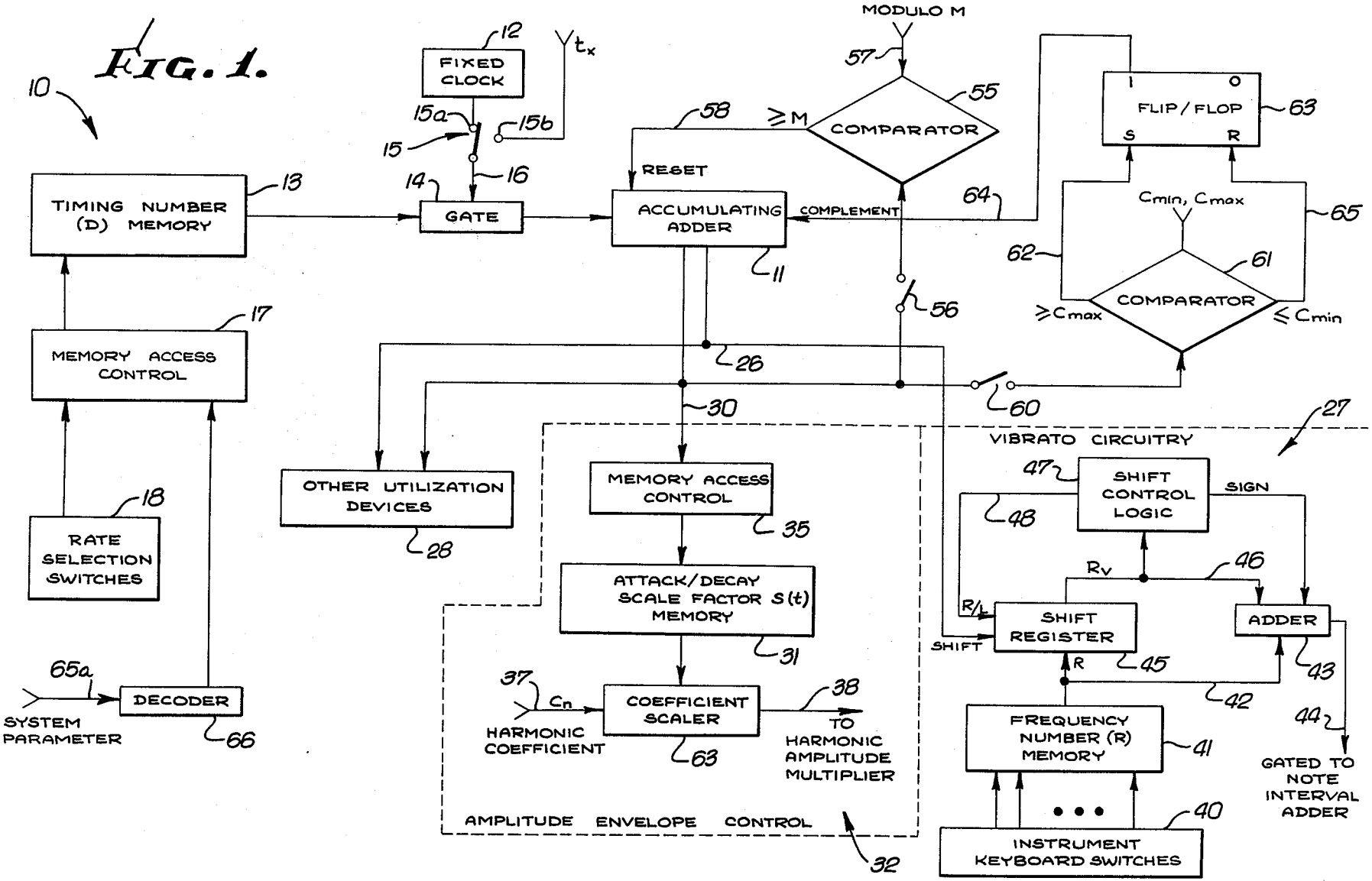
FIG. 1.
10
TIMING NUMBER (D) MEMORY
13
MEMORY ACCESS CONTROL
17
RATE SELECTION SWITCHES
18
DECODER
66
65a
SYSTEM PARAMETER
FIXED CLOCK
12
15a
15
15b
$t_x$
16
GATE
14
ACCUMULATING ADDER
11
RESET
58
MODULO M
57
COMPARATOR
55
≥M
COMPLEMENT
64
56
26
30
60
OTHER UTILIZATION DEVICES
28
MEMORY ACCESS CONTROL
35
ATTACK/DECAY SCALE FACTOR S(t) MEMORY
31
COEFFICIENT SCALER
63
$C_n$
37
HARMONIC COEFFICIENT
38
TO HARMONIC AMPLITUDE MULTIPLIER
32
AMPLITUDE ENVELOPE CONTROL
FLIP/FLOP
63
S
R
COMPARATOR
61
$C_{min}, C_{max}$
≤ $C_{min}$
≥ $C_{max}$
62
65
27
VIBRATO CIRCUITRY
SHIFT CONTROL LOGIC
47
48
SIGN
46
ADDER
43
42
44
GATED TO NOTE INTERVAL ADDER
SHIFT REGISTER
45
$R_v$
R
R/L
SHIFT
FREQUENCY NUMBER (R) MEMORY
41
INSTRUMENT KEYBOARD SWITCHES
40

ACCUMULATING ADDER
11
25-0
25-1
27
26
25-4
25-5
25-2
25-3
25-6
25-7
25-j
30
FIXED RATE CLOCK PULSES
$t_f$
16
14
14-4
14-3
14-2
14-1
14'
13
13'
21-4
21-3
21-2
21-1
22-i
22-4
22-3
22-2
22-1
20-4
20-3
20-2
20-1
$D_1$
$D_2$
$D_3$
$D_4$
18a
18'
23
+V
$R_b \geq R > R_c$
$R_a \geq R > R_b$
COMPARATOR
69
COMPARATOR
68
$R_c$
$R_b$
$R_a$
67
R
42

DIGITAL TIMING SYSTEM FOR AN ELECTRONIC MUSICAL INSTRUMENT

BACKGROUND OF THE INVENTION

1. Field of the Invention

The present invention relates to controllable timing circuitry for digital electronic musical instruments.

2. Description of the Prior Art

In electronic musical instruments, many functions other than the determination of the note fundamental frequency are carried out at clock rates that preferably are independently adjustable. For example, the amplitude envelope of the generated tone may be established by a set of amplitude scale factors that are supplied at a selectable rate which establishes the attack, decay, sustain and release duration of each note. Other functions include vibrato and tremolo modulation effects, arpeggio and glissando, and various sliding formant effects.

An oscillator of adjustable frequency may be used as the time standard for rate control of such functions. However, the use of an analog oscillator in a digital tone generating system requires some artifice to convert the analog clock signals to a form usable with digital circuitry. One such artifice involves the use of an analog square wave oscillator and a counter that is incremented or decremented each time the oscillator square wave output changes sign. The counter contents may be used e.g., to address a memory storing tonal modification scale factors. The clock rate can be controlled in analog fashion by changing some oscillator component value, such as the capacitance or resistance in an RC time constant circuit.

Among the disadvantages of such a hybrid analog-digital timing system is the problem of controlling the clock rate in response to some digital system parameter. For example, it may be desirable to vary the attack-/release amplitude envelope duration as a function of the selected note or octave, so that the attack or release time for notes of lower octaves is longer than for notes of higher octaves. If the fundamental frequency of the generated note is specified by a digital number, digital-to-analog converter circuitry may be required to enable adjustment of an analog oscillator clock rate in response to the selected frequency number.

Thus is it an object of the present invention to provide a digital timing system for use in a digital electronic musical instrument. The inventive system advantageously is used as the time base for modulation and special effects other than note frequency determination.

A further object is to provide such a digital timing system in which digital rate control readily can be implemented.

SUMMARY OF THE INVENTION

These and other objects are achieved in a digital musical instrument by providing timing circuitry comprising an accumulating adder which consecutively sums a selectable digital timing number D. The accumulation is accomplished at a fixed rate, so that the accumulator contents is a time dependent function directly related to the value of the timing number D. The accumulator contents, or a portion thereof, may be used directly to address a memory storing modulation scale factors or other time variant musical instrument parameter. Alternatively, a timing pulse train at the digitally controlled rate can be obtained from a selectable bit position of the accumulating adder.

The timing numbers D may be obtained by selective accessing of a memory storing a set of such numbers. Alternatively, the timing numbers may be derived in response to other system parameters, for example by decoding of a frequency number controlling the fundamental frequency of the generated tone.

BRIEF DESCRIPTION OF THE DRAWINGS

A detailed description of the invention will be made with reference to the accompanying drawings wherein like numerals designate corresponding elements in the several figures.

FIG. 1 is an electrical block diagram of digital timing circuitry for an electronic musical instrument in accordance with the present invention.

DESCRIPTION OF THE PREFERRED EMBODIMENTS

Figure 2:
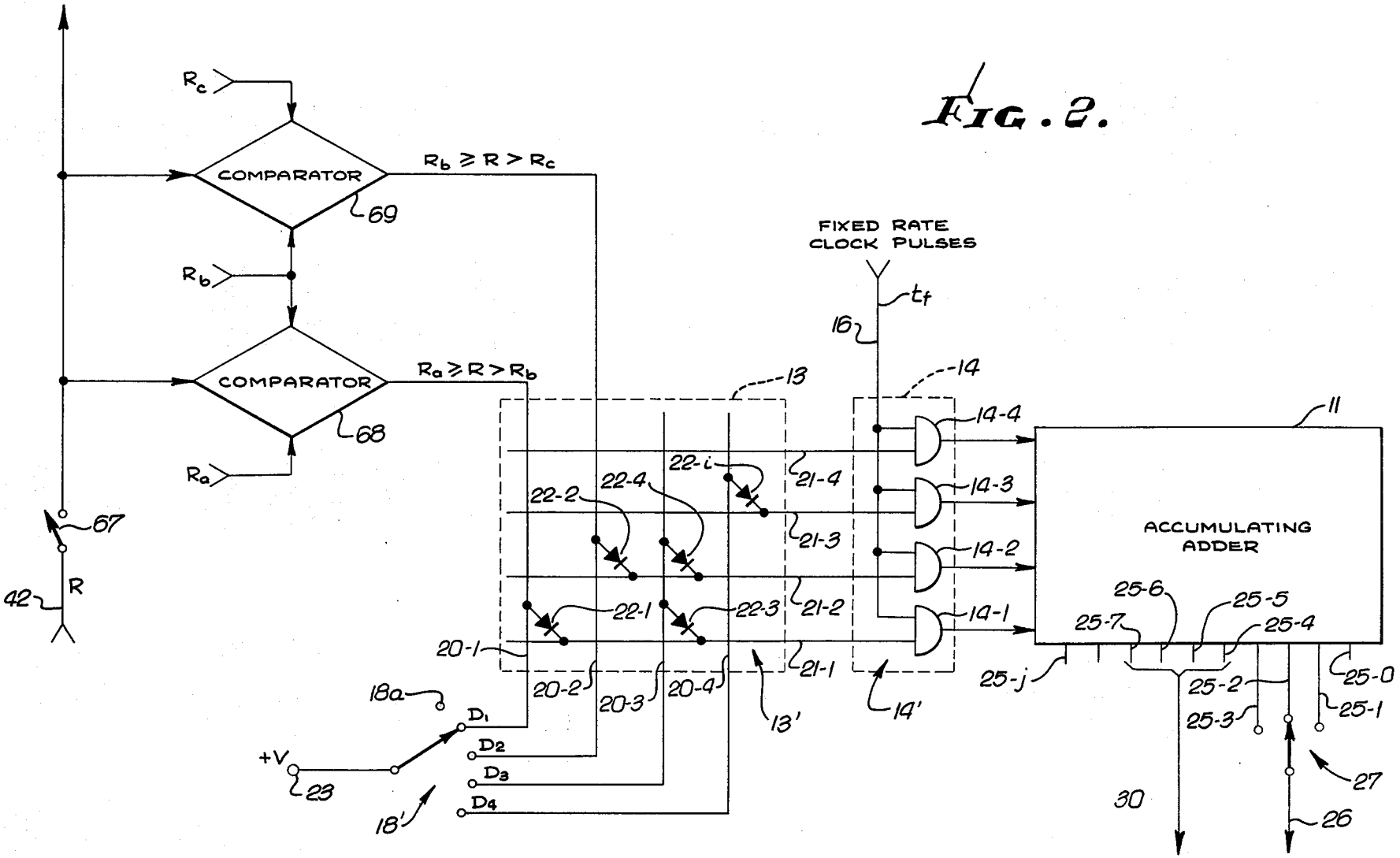
FIG. 2 is an electrical schematic diagram showing an illustrative configuration of certain portions of the digital timing circuitry of FIG. 1.

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

In the illustrative circuitry 10 of FIG. 1, controllable timing in a digital electronic musical instrument is implemented by consecutively adding a selected digital timing number D to itself in an accumulating adder 11. Such addition occurs at a fixed rate $t_f$ established by a clock 12. The selected timing number D is gated from a memory 13 to the accumulating adder 11 via a gate 14 that is enabled by the clock 12 pulses supplied via a switch 15, a switch contact 15*a* and a line 16.

Controllable timing signals are obtained from the contents of the accumulating adder 11 for utilization as described below. The rate of these timing signals is directly proportional to the value of the selected digital timing number D, since the timing numbers are gated and accumulated at a fixed rate. To facilitate rate selection, a set of the timing numbers D are stored in the memory 13. A selected one of these timing numbers D is accessed from the memory 13 by a control circuit 17 in response to the setting of certain rate selection switches 18.

In the typical embodiment of FIG. 2, the memory 13 comprises a diode array 13' having a plurality of columnar lines 20-1 through 20-4 and a plurality of row lines 21-1 through 21-4. Timing numbers D are represented by combinations of diodes 22-*l* through 22-*i* connected in known fashion at the matrix intersections of the column and row lines. Thus in the example shown, a first timing number $D_1$ has the binary value 0001 implemented by a diode 22-1 connecting the lines 20-1 and 21-1, with no diodes at the intersections between the columnar line 20-1 and the row lines 21-2 through 21-4.

This timing number $D_1$ is selected by setting a rotary rate selection switch 18′ to the position shown in FIG. 2. A voltage +V supplied from a terminal 23 energizes the line 20-1 to access the timing number $D_1$ from the memory 13. This timing number $D_1$ in binary form is present on the lines 21-1 through 21-4. Specifically, the voltage +V is communicated via the diode 22-1 to the line 21-1 to represent the single "1" in the timing number code (0001) while the lines 21-2 through 21-4 are low, representing the binary zeros in the code. In the example of FIG. 2, alternate settings of the rate selection switch 18′ will produce the respective codes $D_2$=0010, $D_3$=0011 and $D_4$=0100.

In FIG. 2, the gate 14 comprises a set 14′ of AND gates 14-1 through 14-4 each enabled by the fixed rate clock pulses $t_f$ on the line 16. The timing number D code on the lines 21-1 through 21-4 is gated through the respective gates 14-1 through 14-4 to the accumulating adder 11.

The accumulating adder 11 itself may be implemented using conventional integrated circuit full adders such as the Signetics type SIG 8268 or the Texas Instruments type SN5483, connected as shown in the textbook entitled "Computer Logic" by Ivan Flores, Prentice-Hall, 1960, in Section 11.1 entitled "Accumulators." The binary contents of the adder 11 are available on a plurality of output lines 25-0 through 25-*j*, where the number after the hyphen designates the order of the corresponding bit in the accumulating adder 11 contents.

Different types of timing signals can be derived from the accumulating adder 11. Thus a train of individual timing pulses is obtained on a line 26 that may be connected to any of the individual bit output lines 25-0 through 25-*j*. For ease of description, this selected connection is shown in FIG. 2 by means of a switch 27, but it will be understood that in practice the line 26 normally would be wired directly to a selected one of the adder 11 individual bit outputs.

With the switch 27 set as shown in FIG. 2, a timing pulse will occur on the line 26 each time that a binary one is present on the output line 25-2. The rate of occurrence of these timing pulses thus will depend on the value of the timing number D selected by the switch 18′ and gated to the accumulating adder 11 at the clock rate $t_f$. Thus with the switch 18′ set as shown in FIG. 2, a timing pulse will occur on the line 26 once for each four clock pulses $t_f$. On the other hand, if the rate selection switch 18′ were set to provide the code $D_4$=0100 to the adder 11, a timing pulse will occur on the line 26 each time that the D-number is gated to the adder 11, at a rate equal to $t_f$. Thus the pulse rate on the line 26 is selected by the rate selection switch 18′ and is proportional to the value of the selected timing number D. As shown in FIG. 1, the timing pulse train on the line 26 may be utilized by vibrato circuitry 27 to establish the vibrato frequency, or may be utilized by other devices 28 in the associated electronic musical instrument.

Alternatively, the timing output may be derived from the accumulating adder 11 in the form of a multi-bit parallel binary number which is updated at a rate controlled by the timing number D. For example, the output lines 25-4 through 25-7 together may be provided via a conduit 30 as a 4-bit parallel number which increases in value at a rate established by the selected timing number D. This parallel-binary number advantageously may be used to address a memory containing a set of factors that are to be read out in some sequential order. Thus in FIG. 1 the timing codes on the conduit 30 are used to control the accessing of attack/decay scale factors from a memory 31 included in amplitude envelope control circuitry 32.

In the amplitude envelope control 32, the memory 31 advantageously contains a set of attack/decay scale factors S(*t*) which define the relative envelope amplitude of a note generated by the associated electronic musical instrument. This amplitude envelope typically has the form 34 shown in FIG. 3A, including an attack portion 34*a*, a decay portion 34*b*, a sustain portion 34*c* and a release portion 34*d*. The following table I lists typical scale factor values S(*t*) which may be stored in the memory 31 to produce an envelope like that of FIG. 3A.

TABLE I

| Time Intervals | S(t) Relative Amplitude | S(t) Decibel Equivalent | Time Intervals | S(t) Relative Amplitude | S(t) Decibel Equivalent |
|---|---|---|---|---|---|
| | Attack | | | Sustain | |
| 1 | 0.0031 | −50 | 11 | 0.5007 | −6 |
| 2 | 0.0997 | −20 | ⋮ | ⋮ | ⋮ |
| 3 | 0.2234 | −13 | x | 0.5007 | −6 |
| 4 | 1.0000 | | | Release | |
| | Decay | | x+1 | 0.5007 | −6 |
| 5 | 0.8911 | −1 | x+2 | 0.3976 | −8 |
| 6 | 0.7941 | −2 | x+3 | 0.3157 | −10 |
| 7 | 0.7076 | −3 | x+4 | 0.1255 | −18 |
| 8 | 0.6305 | −4 | x+5 | 0.0560 | −25 |
| 9 | 0.5619 | −5 | x+6 | 0.0223 | −33 |
| 10 | 0.5007 | −6 | x+7 | 0.0031 | −50 |

Advantageously the memory 31 is implemented by using a conventional integrated circuit read only memory such as the Signetics type SIG 8223 or the Texas Instruments type SN5488A. These devices are field-programmable to contain the selected scale factor S(*t*) values. Moreover, they contain memory access control circuitry 35 (FIG. 1) which accepts a parallel binary-coded address signal. Thus the time-variant binary codes present on the conduit 30 may be provided directly to the control 35 so as to access successive scale factors S(*t*) from the memory 31 at a rate established by the selected timing number D supplied from the memory 13. In this way, the rate at which the amplitude envelope 34 is generated can be directly controlled by the rate selection switches 18.

Figure 3A:
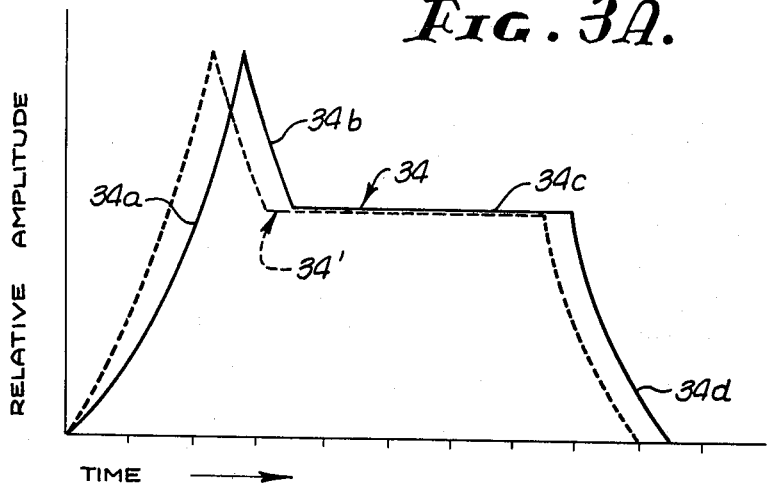
FIGS. 3A and 3B are graphs illustrating control of amplitude envelope timing utilizing the circuitry of FIG. 1.
Figure 3B:
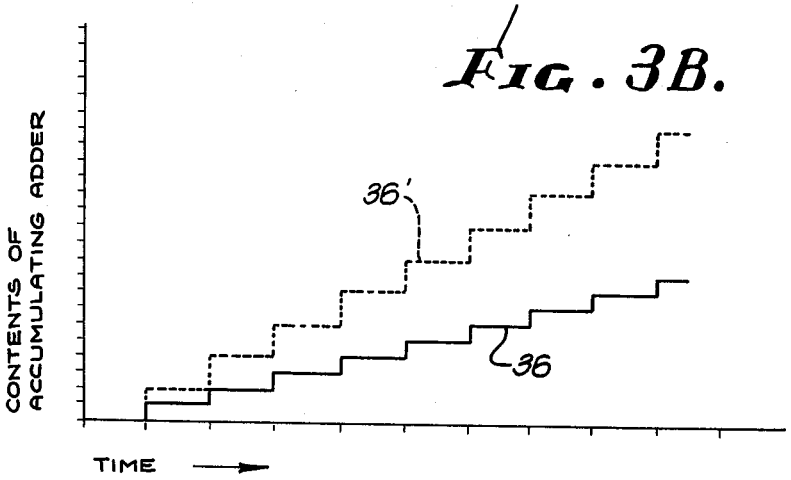

This is illustrated by FIGS. 3A and 3B. As indicated by the curve 36 of FIG. 3B, the contents of the accumulating adder 11 increase in stepwise fashion at the fixed clock rate $t_f$. The amount by which the adder 11 contents is incremented is of course determined by the selected timing number D. As the contents are so incremented, consecutively larger code values are supplied on the conduit 30, so that consecutive scale factors $S(t)$ are accessed from the memory 31 to produce the amplitude envelope 34 (FIG. 3A). If a larger timing number D is selected, the contents of the adder 11 will increase in value at a faster rate, as indicated by the curve 36' of FIG. 3B. As a result, successive scale factors $S(t)$ will be accessed from the memory 31 at a faster rate, and the amplitude envelope will be generated at a correspondingly faster rate as indicated by the broken curve 34' of FIG. 3A.

It should be noted that the particular timing code present on the conduit 30 may not be incremented at each time interval $t_f$. This of course will depend on which particular bit output lines are utilized (i.e., connected to the conduit 30) and on the selected timing number D value.

The scale factors $S(t)$ accessed from the memory 31 advantageously are used to scale in amplitude the tone generated by the associated electronic musical instrument. For example, in an instrument in which a complex musical waveshape is generated on a real time basis, the successive waveshape amplitude values may be multiplied directly by the accessed scale factors $S(t)$. Alternatively, in a COMPUTOR ORGAN of the type disclosed in the inventor's U.S. Pat. No. 3,809,786 the scale factors $S(t)$ may be used to scale the harmonic coefficients $C_n$ which establish the amplitude of the constituent Fourier components present in each generated tone. To this end, the scale factors $S(t)$ are provided from the memory 31 to a coefficient scaler 63 such as that designated by the same number in FIG. 4 of the cited U.S. Pat. No. 3,809,786. Such a scaler multiplies the harmonic coefficient $C_n$ provided on a line 37 by the accessed scale factor $S(t)$ and supplies the product via a line 38 to a harmonic amplitude multiplier such as that designated 33 in FIG. 4 of the cited patent. By scaling the individual harmonic components in this manner, an amplitude envelope such as that shown in FIG. 3A is achieved.

The vibrato circuitry 27 (FIG. 1) illustrates utilization of the controllable rate timing supplied on the line 26. In a COMPUTOR ORGAN of the type disclosed in the above mentioned U.S. Pat. No. 3,809,786 the fundamental frequency of the generated note is established by a frequency number R which is proportional to that fundamental frequency. Each time a note is selected on a set of instrument keyboard switches 40, the corresponding frequency number R is accessed from a memory 41 and supplied to the computer organ circuitry via a line 42. Vibrato may be introduced into the generated note by modulating the frequency number R at a vibrato rate, typically between about 5Hz and 8Hz. This is accomplished in the circuitry 27 by adding to the frequency number R a fractional frequency number $R_v$ which varies periodically in amplitude between k0 and $\pm R_{v_{max}}$. This summation is performed in an adder 43 that supplies the sum $R \pm R_v$ via a line 44 to the computor organ tone generation circuitry. Specifically, the sum is gated via a gate designated 24 in the cited U.S. Pat. No. 3,809,786 to a note interval adder designated 25 in FIG. 1 of the same patent.

Advantageously the fractional frequency number $R_v = R/2^k$ where $k$ is an integer. Where $R$ is a binary number, this equation can be implemented by right shifting the binary value $R$ by $k$ positions, since a right shift of one position corresponds to division by 2. Consequently the value $R_v$ readily can be obtained using a shift register 45 the output ($R_v$) of which is supplied via a line 46 to the adder 43.

To accomplish vibrato frequency modulation, the value $R_v$ must be varied in time at the desired vibrato rate. This is achieved by appropriately shifting the register 45 at a rate established by the timing pulses on the line 26. Periodic variation of the value $R_v$ is achieved by alternately changing the shift direction each time $R_v$ reaches the value 0 or $R_{v_{max}}$. Appropriate shift control logic 47 recognizes when these values of $R_v$ have been reached, and provides the necessary right/left (R/L) shift control signal to the register 45 via a line 48. The logic 47 also provides a sign indicating signal to the adder 43 which alternates between plus and minus each time the fractional frequency number $R_v$ completes an excursion from 0 and $R_{v_{max}}$ and back again to 0.

Figure 4:
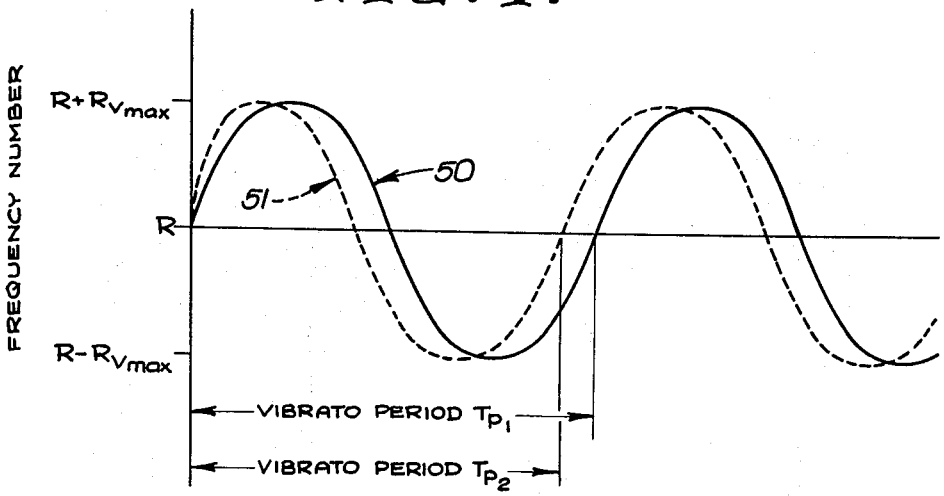
FIG. 4 is a graph illustrating vibrato frequency control using the timing circuitry of FIG. 1.

The resultant periodic variation of the sum ($R+R_v$) provided on the line 44 is represented by the solid curve 50 of FIG. 4. The vibrato period $T_{P1}$ is established by the timing pulse rate on the line 26, which in turn is established by the timing number D supplied from the memory 13. If a larger timing number D is selected, the pulses on the line 26 will occur at a faster rate. As a result, the register 45 will be shifted at a faster rate, and the vibrato period will decrease, as indicated by the broken curve 51 of FIG. 4 having the period $T_{P2}$. Thus selection of the timing number D will directly control the vibrato rate.

Periodically repeating sets of timing control codes also can be obtained using the inventive circuitry 10. This is accomplished by configuring the accumulating adder 11 to be of modulo M. The adder 11 may be internally wired to reset when its contents reach the value M. Alternatively, a comparator 55 may be used to compare the value of the timing code on the line 30, and provided via a closed switch 56, with the modulo value M supplied on a line 57. As soon as the timing code value equals or exceeds M, the comparator 55 produces an output via a line 58 to cause resetting of the accumulating adder 11. In this way, periodically repeating sets of timing control codes will be obtained on the line 30.

In the embodiment just described, within each set of timing codes the values repetitively increase between certain minimum and maximum values. In an alternative mode of operation, implemented by opening the switch 56 and closing a switch 60, the sets of timing codes obtained on the line 30 will vary periodically, first increasing from a minimum value $C_{min}$ to a maximum value $C_{max}$, then decreasing back to the minimum value. To this end, the timing codes on the line 30 are provided to a comparator 61 which also receives the limiting values $C_{min}$ and $C_{max}$. When the value of the timing code on the line 30 reaches or exceeds $C_{max}$, the comparator 61 produces an output via a line 62 to set a flip-flop 63 to the "1" state. As a result, a "complement" signal is provided via a line 64 to the accumulating adder 11. This modifies operation of the adder 11 so as to complement each timing number D received from the gate 14. As a result, that timing number D is subtracted from the previous contents of the adder 11. The contents of the adder 11, and hence the timing codes on the line 30, will decrease in value. Eventually, the value of the timing code on the line 30 will be equal to or less than $C'_{min}$. When this occurs, the comparator 61 will provide an output via a line 65 to reset the flip-flop 63 to the "zero" state. This will terminate the "complement" signal on the line 64 so that the accumulating adder 11 once again will add the supplied timing number D to its previous contents. In this manner, timing codes are provided on the line 30 which periodically increase and decrease between preset limits.

Timing control using the circuitry 10 also may be accomplished in response to certain system parameters within the associated electronic musical instrument. To this end, a digital signal indicative of that parameter may be supplied via a line 65*a* to decoder 66. This decoder 66 cooperates with the control circuit 17 to access from the memory 13 a timing number D having some preselected relationship with the input system parameter value. For example, it may be desirable to control the amplitude envelope (FIG. 3A) as a function of the octave of the selected note. In this case, a digital signal designating the octave containing the selected note would be provided via the line 65*a*. The decoder 66 would be configured to associate this octave value with a corresponding timing number D so as to produce the desired amplitude envelope duration.

Alternatively, the timing number D may be selected directly in response to the frequency number R of the selected note. To this end, the illustrative circuitry shown in FIG. 2 may be employed by turning the switch 18' to the open contact 18*a* and by closing a switch 67 so as to supply the frequency number R from the line 42 to the input of a set of comparators 68, 69.

The comparator 68 ascertains whether the frequency number R lies between certain minimum and maximum range values $R_a$ and $R_b$. If so, a high signal is provided on the line 20-1 so that the timing number $D_1$ will be supplied to the accumulating adder 11. Alternatively, if the frequency number R lies between another set of limits $R_b$ and $R_c$ the comparator 69 will provide a high signal on the line 20-2 so as to supply the timing number $D_2$ to the accumulating adder 11. Additional comparators (not shown) may be used to access other timing numbers D from the memory 13 in response to values of R within different limits.

The comparator 69, and likewise the comparators 55, 61 and 68, may be implemented using Texas Instruments type SN54L85 integrated circuit 4-bit magnitude comparators.

Clock pulses other than those supplied by the clock 12 may be used to enable the gate 14. For example, the amplitude computation timing pulses $t_x$ utilized in the above mentioned patented COMPUTOR ORGAN may be supplied to the gate 14 by setting the switch 15 to the switch contact 15*b*.

Intending to claim all novel, useful and unobvious features shown or described, the applicant claims:

1. In an electronic musical instrument, a digital timing system comprising:

timing number selection means for selecting a digital number from a set of such numbers, an accumulating adder, and gating means for repetitively gating said selected digital number to said accumulating adder for arithmetic addition to the previous contents thereof at a regular rate, digital timing signals being obtained from selected bit positions of said accumulating adder, and utilization means in said electronic musical instrument for employing said obtained digital timing signals to implement tone modification functions.

2. An electronic musical instrument digital timing system according to claim 1 further comprising;

a plural bit parallel timing code output channel connected to a selected plurality of bit positions of said accumulating adder, the contents of the selected adder bit positions being provided via said output channel as a timing code, said timing code being updated at said regular rate by an amount established by said selected digital number.

3. An electronic musical instrument digital timing system according to claim 2 wherein said utilization means comprises;

a scale factor memory storing a set of scale factors utilized in time dependent order for tone modification in said electronic musical instrument, and a memory access control circuit receiving said timing code from said output channel and accessing from said memory a scale factor having an address designated by the value of said timing code, the updating of said timing code thereby effectuating the sequential access of subsets of said scale factors at a timing rate established by said selected digital number.

4. An electronic musical instrument digital timing system according to claim 1 further comprising;

a timing pulse train output line connected to a selected bit position of said accumulating adder, the rate of the timing pulse train obtained on said output line being proportional to said selected digital number.

5. An electronic musical instrument digital timing system according to claim 4 wherein said utilization means comprises;

tone modulation circuitry, receiving said timing pulse train from said output line, for modulating the tone generated by said electronic musical instrument at a rate established by said pulse train rate.

6. An electronic musical instrument digital timing system according to claim 4, wherein said instrument includes a tone generator which generates a note having a fundamental frequency that is proportional to a frequency number R supplied thereto and wherein said utilization means produces vibrato in the generated note, said utilization means comprising;

circuitry for providing a fractional frequency number $R_v$ having a value which varies periodically between certain maximum and minimum limits, said circuitry including a shift register the contents of which represents $R_v$, said circuitry receiving said timing pulse train from said output line and utilizing said timing pulses for incrementing or decrementing the contents of said shift register, thereby imparting said periodicity to said number $R_v$ at a rate established by said timing pulse train, and an adder for adding the fractional frequency number $R_v$ from said circuitry to the frequency number R and for providing the algebraic sum to said tone generator for establishing therein the frequency of the generated note, said generated note thereby exhibiting vibrato at a rate established by the selected digital number.

7. An electronic musical instrument digital timing system according to claim 1 wherein said timing number selection means comprises;

a timing number memory storing said set of digital numbers, a rate selection switch, and access control circuitry for accessing from said memory a digital number selected by said switch, and wherein said gating means comprises;

a source of clock pulses at a fixed rate, and a gate enabled by said fixed rate clock pulses for gating the selected digital number accessed from said memory to said accumulating adder.

8. An electronic musical instrument digital timing system according to claim 2 further comprising;

resetting circuitry cooperating with said accumulating adder to cause resetting thereof when the contents of said adder reach a certain preselected value, whereby repetitive sets of timing codes are produced.

9. An electronic musical instrument digital timing system according to claim 2 further comprising;

complementing circuitry cooperating with said accumulating adder for causing the gated digital number to be subtracted from the previous contents of said accumulating adder, and control circuitry responsive to the contents of said accumulating adder for selectively enabling said complementing circuitry when said contents reach certain limits, whereby the contents of said accumulating adder are periodically incremented or decremented so as to produce periodically varying timing codes on said output channel.

10. An electronic musical instrument digital timing system according to claim 1 wherein the rate of said digital timing signals is controlled in response to a certain system parameter of said instrument, wherein said timing number selection means comprises;

a timing number memory storing a set of said digital numbers, and a decoder receiving signals indicative of said certain parameter, and access control circuitry cooperating with said decode for accessing from said memory a selected digital number having an address designated by the certain parameter as decoded by said decoder.

* * * * *